US009353593B1

(12) United States Patent
Lu et al.

(10) Patent No.: US 9,353,593 B1
(45) Date of Patent: May 31, 2016

(54) HANDLER FOR BLOWOUT PREVENTER ASSEMBLY

(71) Applicant: National Oilwell Varco, L.P., Houston, TX (US)

(72) Inventors: Mike Xiaolei Lu, Arlington, TX (US); David W. McCulloch, Arlington, TX (US)

(73) Assignee: National Oilwell Varco, LP, Houston, TX (US)

( * ) Notice: Subject to any disclaimer, the term of this patent is extended or adjusted under 35 U.S.C. 154(b) by 0 days.

(21) Appl. No.: 14/658,110

(22) Filed: Mar. 13, 2015

(51) Int. Cl.
*E21B 33/06* (2006.01)
*E21B 19/00* (2006.01)

(52) U.S. Cl.
CPC ..... *E21B 33/06* (2013.01); *E21B 19/00* (2013.01)

(58) Field of Classification Search
CPC ..... E21B 19/00; E21B 33/06; B66C 19/00; B66C 19/02; B66F 9/14; B66F 9/16
USPC ..... 166/379, 79.1, 85.4; 414/642, 672, 666
See application file for complete search history.

(56) References Cited

U.S. PATENT DOCUMENTS 6,129,226 A * 10/2000 Donovan ..... B66C 23/54 212/238
7,040,411 B2 5/2006 Kainer et al.
7,077,209 B2 7/2006 McCulloch et al.
7,389,820 B2 * 6/2008 Day ..... E21B 15/045 166/379
2005/0247456 A1 11/2005 Wise et al.
2007/0125551 A1 6/2007 Havinga
2011/0259602 A1 * 10/2011 Britton ..... E21B 19/00 166/379

OTHER PUBLICATIONS

"Enhanced QuikRig Coiled Tubing System," Halliburton, Boots & Coots, Jan. 2014, 6 pages.
"BOP Handling and Transporter System," Veristic Manufacturing, Inc., printed on Sep. 22, 2014, 1 page.

* cited by examiner

*Primary Examiner* — Jennifer H Gay
*Assistant Examiner* — George Gray
(74) *Attorney, Agent, or Firm* — Derek V. Forinash; Porter Hedges LLP

(57) ABSTRACT

A handler holds a blowout preventer (BOP) assembly (partially or fully assembled) for transport and then erects it from a transport position to a vertical position for deployment. In the transport position the BOP assembly generally rests in a horizontal position. During deployment of the BOP assembly by the handler, the handler is capable of moving the BOP assembly to a vertical position, elevating it, and moving it outward, away from the base of the handler and toward a wellhead, so that the BOP assembly may be connected to a coiled tubing injector, work may be performed underneath the BOP assembly before connection to a well head, and the BOP assembly may be placed on top of a well head for connection to the well head.

22 Claims, 5 Drawing Sheets

HANDLER FOR BLOWOUT PREVENTER ASSEMBLY

TECHNICAL FIELD OF THE INVENTION

The invention pertains generally to handlers for positioning high pressure blow out preventer assemblies and the like above well heads in oilfield service operations.

BACKGROUND

Coiled steel tubing, or simply "coiled tubing," is single string of steel pipe that is continuously milled and coiled onto a large take-up reel for transportation and handling. It can be run into and out of a well bore at a high rate, relative to straight, jointed pipe, and, unlike wire line, it can be pushed into the well bore. It has been manufactured in lengths greater than 30,000 feet. Useful in a wide range of oilfield services and operations, including drilling, it is more often used after the well is drilled for logging, cleanouts, fracturing, cementing, fishing, completion and production related operations.

Coiled tubing is run in and out of well bores using a machine called a coiled tubing injector. The name "coiled tubing injector" derives from the fact that, in preexisting well bores, the tubing may need to be forced or "injected" into the well through a sliding seal to overcome the pressure of fluid within the well, until the weight of the tubing in the well exceeds the force produced by the pressure acting against the cross-sectional area of the pipe. However, once the weight of the tubing overcomes the pressure, the coiled tubing injector must hold it to prevent it from sliding further into the well bore.

When using coiled tubing to lower tools for performing operations relating to completing a well or working over existing wells, a blow out preventer (BOP) will be used for pressure control. The BOP is attached to the well head, and a coiled tubing injector is attached to the top of the BOP. In addition to a BOP one more of the following are can be attached to the top of a wellhead, through which the tools and coiled tubing may be lowered: a stripper, one or more sections of risers for accommodating one or more down hole tools for connection to coiled tubing prior to insertion into the well bore, a flow cross, and a backup BOP. The combination of a BOP with one or more other components is referred to as a BOP assembly. A BOP assembly may also be referred to as a pressure control stack. The exact components of the BOP assembly depends on the particular well, the work that needs to be performed on the well, and the down hole tools that will be used.

The BOP assembly can be assembled and transported to the well site. However, components of the BOP assembly—the BOP, the risers, and the stripper—are often transported to the well site for assembly. There also may be variation in the type of connectors used to connect the components of the BOP assembly. Generally, for well pressures up to and including 10,000 pounds per square inch (PSI) (68,948 kPa) quick connect fittings can be used to connect the components of the BOP assembly. However, where well pressures are expected above 10,000 PSI, connections between the components must be connected in a fashion to withstand these pressures. Connections between the various components of pressure control equipment, rated for service above 10,000 PSI, are required to be API ring bolted connections capable of withstanding the well head pressure. Connection of the various components of the BOP assembly could require making as many as six or seven of these connections, which involves fitting the seal rings and flange fasteners and then tightening them carefully.

When a BOP assembly is assembled at a well site, the assembly of the components, by the nature of their design, must be done vertically. People having to perform the work do so at elevated work stations. Additionally, the assembly of tools on the end of the coiled tubing must be done with the tubing running through the risers and BOP, below the bottom flange of the BOP, before the BOP assembly is connected to the wellhead. The components of the BOP assembly are typically suspended from a crane when the connections are being made. Usually this means that a coiled tubing injector is picked up first by a crane. After being picked up, the risers are connected to the coiled tubing injector, and then the BOP is connected to a bottom end of the risers. The entire assembly of injector, risers, and BOP will therefore be suspended from the crane. This is all done with one end of the coiled tubing from an adjacent reel inserted or "stabbed" into the coiled tubing injector. To attach the tools to the end of the coiled tubing, both the injector and BOP assembly are lifted by a crane high enough to connect the tools to the end of the coiled tubing that has been inserted through the risers and the bottom end of the BOP. The tools are sometimes very long. Installing and connecting the tools to the tubing is tedious and time consuming, usually involving more than one person.

Once the tools are connected to the coiled tubing, the entire assembly is then placed, by crane, on the wellhead and attached to the wellhead. After completion of the well intervention, cranes are again used to remove the BOP assembly from the wellhead and the coiled tubing injector and to dissemble the BOP assembly.

SUMMARY OF THE INVENTION

The invention pertains generally to a handler for positioning a BOP assembly at the oil or gas well site for connection to a well head and a coiled tubing injector.

According to one aspect of a representative embodiment of the handler, the handler holds a BOP assembly (partially or fully assembled) for transport and then erects it from a transport position to a vertical position for deployment. In the transport position the BOP assembly generally rests in a horizontal position. During deployment of the BOP assembly by the handler, the handler is capable of moving the BOP assembly to a vertical position, elevating it, and moving it outward, away from the base of the handler and toward a wellhead, so that the BOP assembly may be connected to a coiled tubing injector, work may be performed underneath the BOP assembly before connection to a well head, and the BOP assembly may be placed on top of a well head for connection to the well head. This aspect of the invention provides a relatively safe work space under the injector and BOP stack for this operation, as compared to the conventional way of performing the work while the injector and BOP assembly is suspended from a crane.

Another aspect of a representative embodiment of a handler comprises a frame on which is mounted a cradle for supporting the BOP assembly, the handler being capable of positioning the frame above and generally over the well head. According to one further aspect of this embodiment of the BOP handler, the cradle is mounted to the frame for translation along a horizontal axis with respect to the frame. In another, different aspect, the cradle is mounted on the frame for raising and lowering the BOP assembly in a generally vertical direction, along a central axis of the BOP assembly, without the handler having to move the frame. In yet another aspect of this embodiment of a BOP assembly, the BOP assembly is rotatable with respect to the frame. Any combination of these aspects may be included in the handler, so that the BOP assembly can be manipulated for alignment with and connection to a coiled tubing injector and/or a well head.

DETAILED DESCRIPTION OF EXEMPLARY EMBODIMENTS

Figure 1:
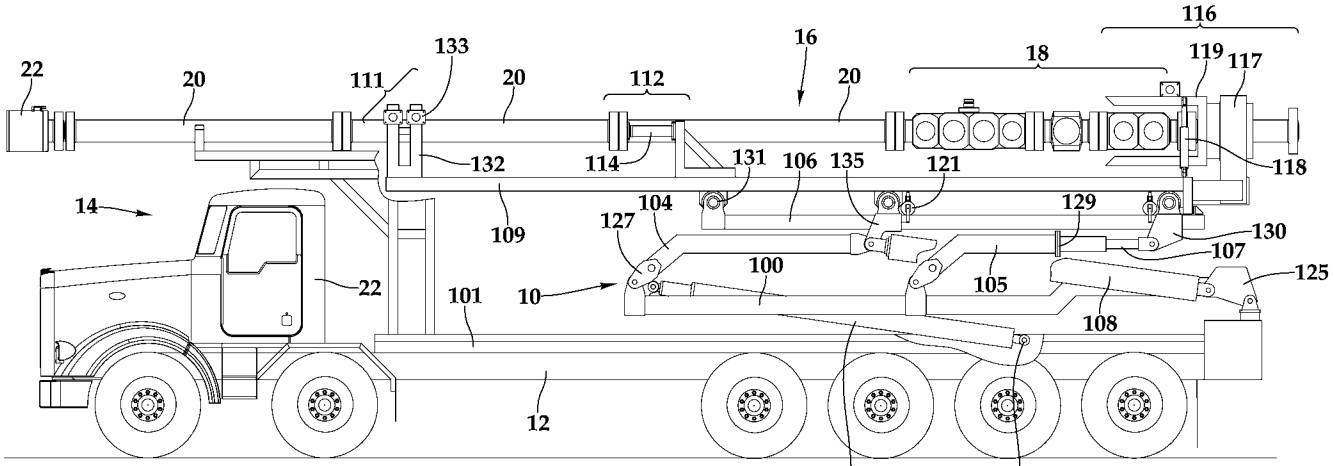
FIG. 1 is a side view of an example of a BOP assembly handler in a transport position.

In the following description, like numbers refer to like elements.

A representative example of an embodiment of a BOP assembly handler is capable of stowing in a horizontal position a partially or fully assembled blow out preventer (BOP) assembly and then maneuvering it over a wellhead of an oil or gas well for attachment and, if desired, support. Such a handler comprises a linkage for maneuvering a support frame that carries the BOP assembly. The linkage is capable of not only standing the BOP assembly up, but also raising it vertically and moving it horizontally away from the base of the handler. It also, preferably, raises it high enough and far enough beyond the end of the base on which the handler is mounted, to allow for insertion of tools within the risers, and then also laterally over the wellhead, where it can be connected to wellhead. Once connected to the wellhead, it may be used to support the weight of the BOP assembly and, optionally, the coiled tubing injector attached to the top of the BOP assembly. Thus, although a crane, mast or other mechanism will be required for attaching the coiled tubing injector to the riser, the crane need not be, if desired, used to support the weight of the injector. Even if the crane is used to support, in whole or in part, the weight of the injector and/or the BOP assembly, the handler can be used to transfer a side load on the BOP assembly, and thus also the wellhead, imposed by the tension placed on the coiled tubing being fed to the coiled tubing injector, thus eliminating the complex and risky task of manipulating the crane for this purpose.

The linkage, for example, comprises a first link that pivots with respect to a base, from a position that is substantially horizontal to which one in which it is substantially vertical. Two additional links, each pivotally attached between the first link and the support frame (the support frame also constituting a link in the linkage) in a parallel fashion, are used to move the support frame outwardly and upwardly from first link. The two parallel links keep the orientation of the support frame with respect to the first link constant as the first link as the support frame moves between a stowed position, in which it is positioned near to the first link to provide for compact storage and transport, and an extended position in which the support frame has been moved outwardly from the first link and moved higher with respect to the first link. Thus, once the first link pivots to the vertical position, the BOP assembly will be positioned vertically. As the two links in parallel are pivoted with respect to the first link, the support frame and the BOP assembly will remain substantially vertical as they are moved outwardly and lifted up by the pivoting action of the two parallel arms. One or both of the parallel links may, optionally, be made extendable, allowing the orientation of the support frame to be tilted with respect to the first link in order to accommodate, for example, situations in which the axis of the well head is not be perfectly vertical.

A different aspect of the handler allows for the BOP assembly to be supported, if desired, on the frame in a manner that permits movement of the BOP assembly with respect to the support frame, without having to operate the linkage that maneuvers and lifts the support frame. The components of the linkage used to stand and maneuver the support frame have much longer throws or ranges of motion, and thus will tend to be more difficult to manipulate for positioning of the BOP assembly to align it with the wellhead. The BOP assembly may be moved with respect to the support frame in one or more of the following ways: rotating the BOP assembly; laterally shifting the BOP assembly; and lifting and lowering the BOP assembly in parallel to the support frame.

FIGS. 1 to 5 illustrate a representative example 10 of such a handler. The handler 10 is mounted on a bed 12 of a truck 14 for transporting both the handler and the BOP assembly 16 to the well site. The BOP assembly 16 comprises, in the example, a BOP 18 in combination with one or more risers 20. The illustrated BOP has several stages, and includes a backup BOP. It is intended only to be representative; the number of stages and whether a backup is included depends on the well and work to be done. Three risers are shown. Again, a particular job may require fewer or more than shown, as the number of risers depends how many are required to accommodate the length of the tools that will be attached to the end of coiled tubing (not shown.) A coiled tubing injector (not shown) will be attached to the stripper 22 at the top of the BOP assembly, and tubing run down through the riser and BOP assembly to allow tools to be attached to it before the BOP assembly is attached to the top of the well head 24. The BOP assembly 16 is intended to be only representative generally of BOP assemblies. Though shown fully assembled, the BOP assembly could be partially assembled. For example if additional riser sections or other components might be required for a particular job at a well site, a partially assembly BOP assembly could be transported.

The handler 10 may, alternatively, be mounted to another type of vehicle, a trailer, a skid or other structure that is capable of acting as a base for the handler when deployed at a well site. This example of a handler is designed to be compact enough to be transported, with the BOP assembly, to a well site over public roads without having to assemble the handler or the BOP assembly (assuming that it is not too long on a vehicle or trailer on which it is mounted) once it reaches the well site. However, aspects of the handler could be usefully applied in applications in which a handler is set up at the well site for an extended period of time. In FIG. 1 the handler 10 is shown in a fully collapsed position for transport, compactly tucked in behind the cabin 22 of the truck, with only a portion supporting the BOP assembly extending over the top of the cabin. In the collapsed position, the handler supports the BOP assembly 16 in a horizontal position and secures it for transport.

Figure 2:
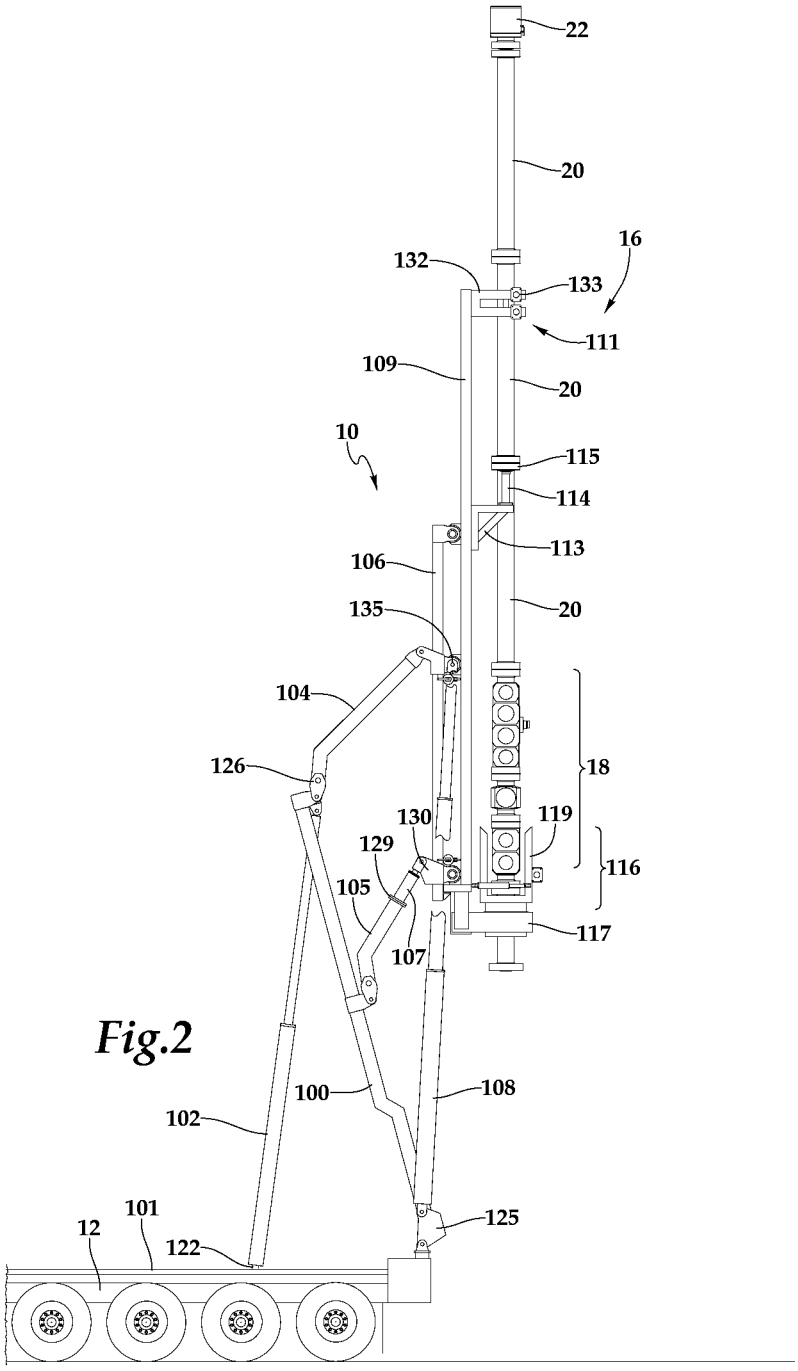
FIG. 2 is a side view of an example of a BOP assembly handler of FIG. 1 in a vertical but not extended position.
Figure 3:
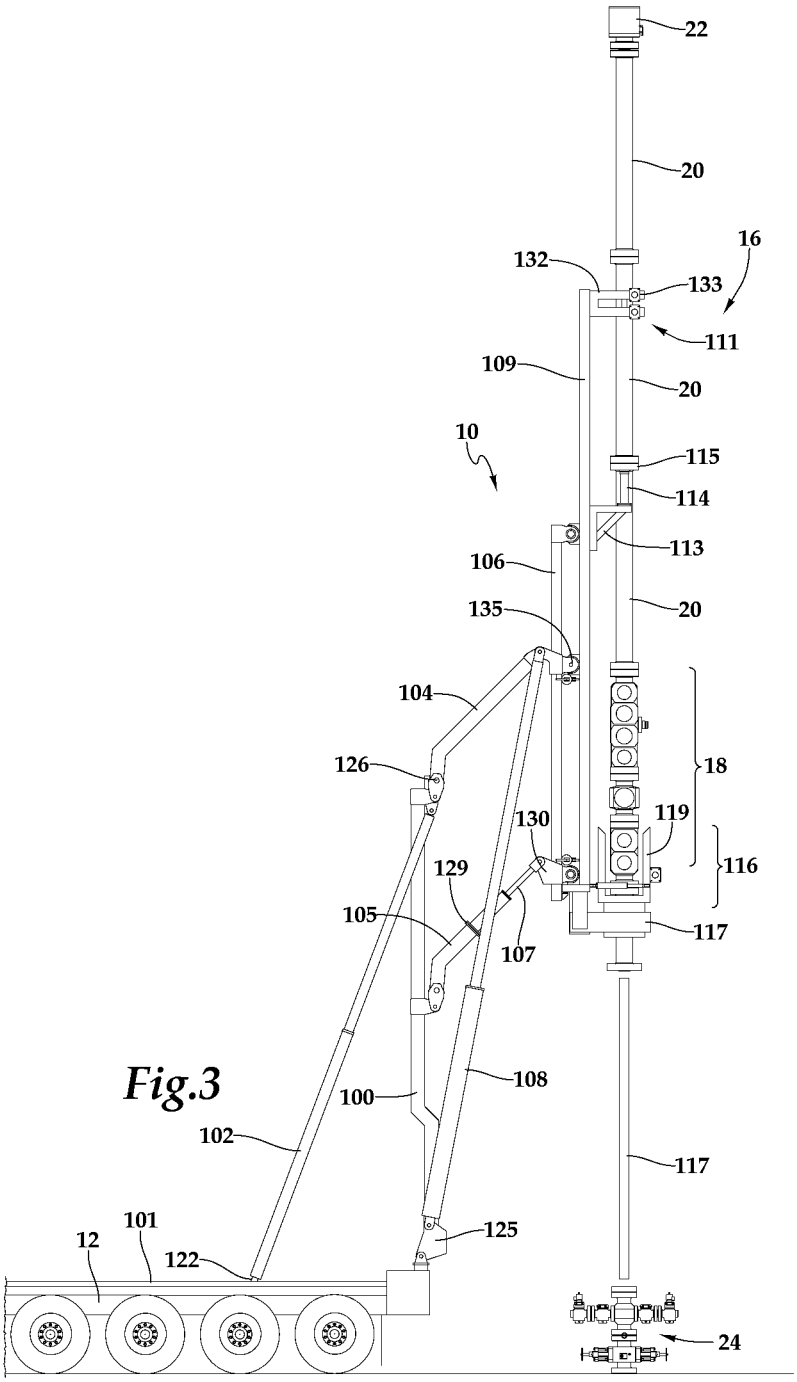
FIG. 3 is a side view of an example of a BOP Handler of FIG. 1 in a vertical and extended position.
Figure 4:
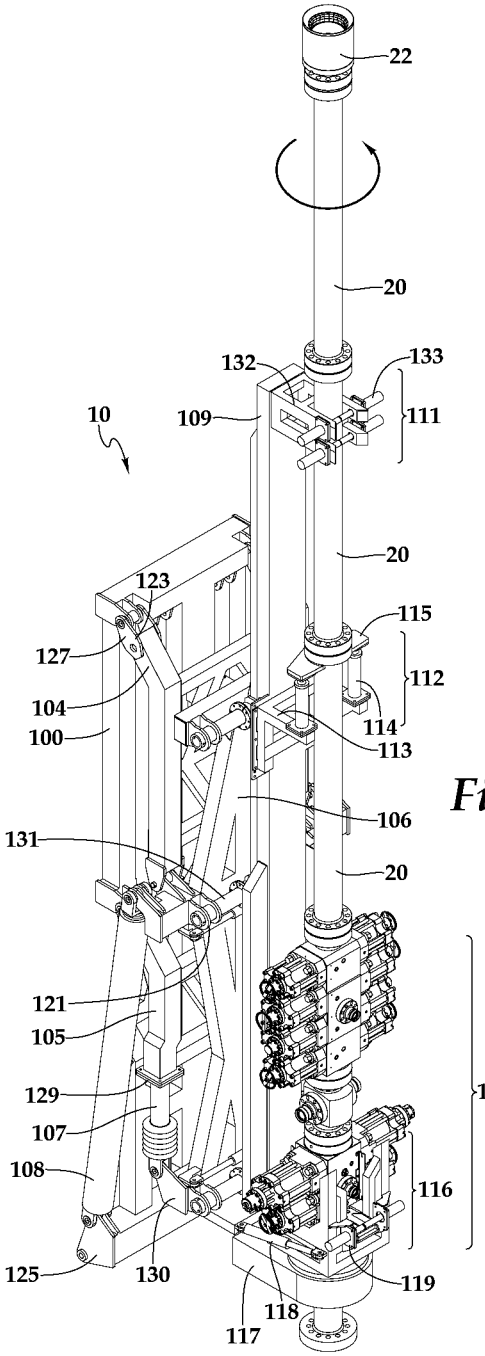
FIG. 4 is a perspective view of the example of a BOP assembly handler shown in FIGS. 1-3, without depiction of its base or vehicle support, in a vertical orientation.
Figure 5:
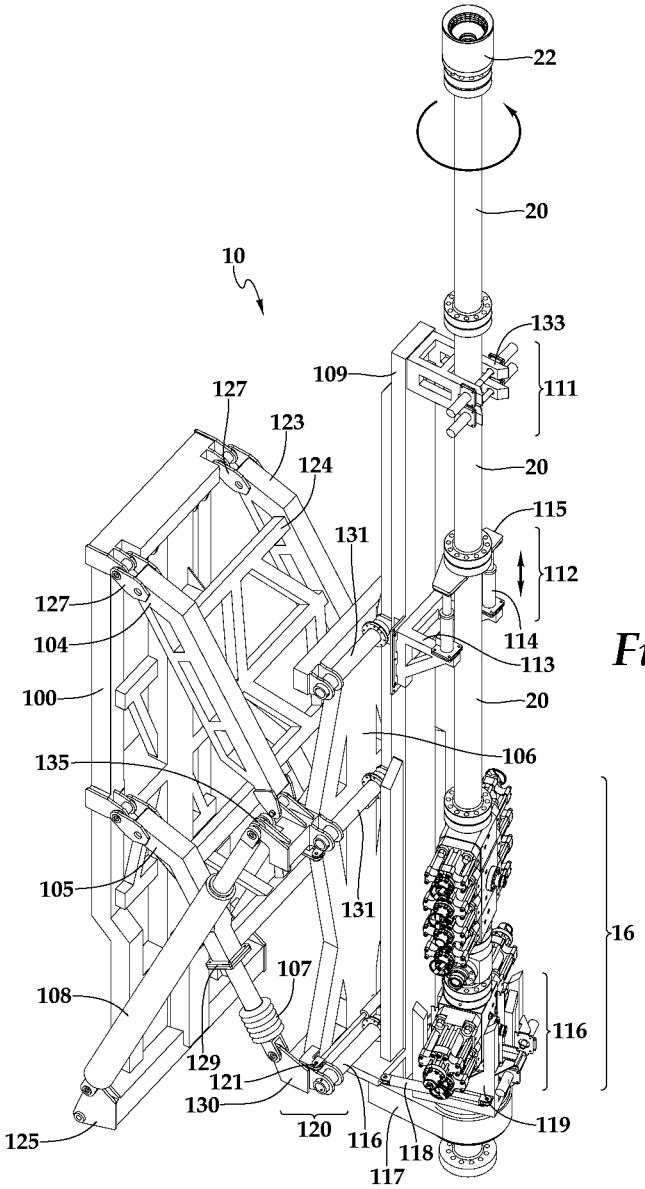
FIG. 5 is a perspective view of the example of a BOP assembly handler shown in FIG. 4 indicating the lateral, vertical, and rotational movement capabilities of the example.

In FIG. 1 the BOP assembly handler is, as previously described, in a collapsed or transport position. When mounted on a vehicle for transport, the BOP assembly handler 10 with the secured BOP assembly 18 would, for example, be transported and arrive at a well site in the transport position shown in FIG. 1. When positioned near a wellhead at the site, the handler tilts or stands up the BOP assembly 16 to vertical position as shown in FIG. 2. After standing up the BOP assembly 16 the handler keeps the BOP assembly in a substantially vertical orientation, as shown in FIGS. 3, 4 and 5. Thus, in the illustrated embodiment the handler 10 is capable of moving the BOP assembly 16 laterally (horizontally) away from the base 101 and toward the well head 24, as well as in a vertical direction. Lateral and vertical maneuvering of the BOP assembly by the handler, which is indicated by its different positions in FIGS. 3 and 5, allows for one or more of the following while still being supported by the handler: connecting a coiled tubing injector (not shown) to the BOP assembly 16; attaching one or more downhole tools to the end of coiled tubing that has been inserted through the BOP assembly 16, as indicated by FIG. 3, and pulling those tools back into the riser; and aligning and connecting the BOP assembly a well head, as indicated by FIGS. 4 and 5. FIG. 5 depicts the BOP handler in a position in which the BOP handler has extended the BOP assembly away from the base 101 and also elevated the BOP assembly over a well head (not shown in the figure), with the BOP handler lifted, relative to the position depicted in FIG. 4. In the positions shown in FIGS. 3 and 5, the underside of the BOP assembly is accessible to allow access for connection of an intervention tool to coiled tubing that has been feed through the BOP assembly and extends underneath the BOP assembly.

In addition to the handler's movement capabilities used to maneuver the linkage that supports the BOP assembly, the illustrated handler is also capable of maneuvering the BOP assembly on a finer scale so as to allow for positioning and aligning BOP assembly 16 with a well head or with a coiled tubing injector. Use of couplings that allow for movement of the BOP independent of the handler or movement of BOP support 109 independent of the other linkage components of the handler. In the illustrated embodiment, the handler is capable of rotating BOP assembly 16 about its axis, vertically raising and lowering BOP assembly 16, and laterally shifting BOP assembly 16. Use of these movement capabilities allow for a BOP assembly, once erected and elevated by the linkage of the handler near a well head, to be manipulated in a more precise manner for positioning over the well head and alignment with the well head. In a likewise manner, these movement capabilities provide for positioning and alignment of BOP assembly 16 with a coiled tubing injector.

In the embodiment depicted, frame 100 is as a first, rigid link of the linkage of the handler that maneuvers BOP assembly 106 between a transport position and an upright and elevated position. Frame 100 is pivotally coupled to base 101, such connection being made at the proximate end of frame 101 by joint in the form of pivotal connector 125. In the example base 101 is comprised of the bed of a truck 12. However, other structures may be used for base 101. These other structures include, without limitation, a trailer, skid, platform, or frame. In the depicted embodiment, first frame 100 is comprised of at least two of parallel rigid beams 123 coupled to a plurality of cross bracing 124. Other embodiments of the first frame 100 may also provide the proper rigidity and support for the BOP assembly 16 and other handler components. By way of example a single beam could be used as first frame 100 if it possessed sufficient strength to carry the load, and if it and the joint connecting it to the base are capable of resisting torsional forces placed on the beam. More than two beams could also be used to form the frame.

In the illustrated embodiment of the handler, the proximate end of extendable member 102 is pivotally coupled to base 101 at pivotal connection 122. The distal end of extendable member 102 is pivotally coupled to the distal end of first frame 100 at pivotal connection 126, so that when first extended member 102 is retracted, first frame 100 is relatively parallel to base 101. When the first extendable member 102 is nearly fully extended the first frame 100 is relatively perpendicular to the base 101. By retracting or extending the extendable member 102, the orientation of a BOP assembly 16 may be changed from a relatively horizontal orientation to a vertical orientation and vice versa. In this manner, first extendable member 102 provides at least part of the movement capability of the handler involved in maneuvering the linkage from a transport position to a maneuvers BOP assembly 106 between a transport position and an upright and elevated position.

In the illustrated embodiment of the handler, first swing arm 104 is pivotally coupled at its proximate end to the distal end of the first frame 100, at pivotal connection 127. First swing arm 104 is pivotally coupled to second frame 106 at pivotal connection 134. Second swing arm 105 is pivotally coupled at its proximate end to first frame 100 at pivotal connection 128, such pivotal point 128 being away from pivotal point 127. The distal end of second swing arm 105 is coupled to the proximate end of a second extendable member 107, at connector 129. The distal end of second extendable member 107 is pivotally coupled to second frame 106 at the proximate end of the second frame 106, by pivotal connection 130. Such components and their described connections together form at least part of the linkage for maneuvering the BOP assembly, with the first frame 100, first swing arm 104, second swing arm 105 being individual links of the linkage and second extendable member 107 providing movement capabilities to the linkage components.

First swing arm 104 and second swing arm 105 in the illustrated embodiment, as depicted in FIG. 5, each comprise two parallel beams 123 coupled to a plurality of cross bracings 124 to create a rigid structure. However, a fewer or a greater number of beams and/or cross bracings could be used to construct each of the swing arms. When second extendable member 107 is partially retracted, first frame 100 and second frame 106 are generally parallel to each other. When second extendable member 107 is extended, the proximate end of second frame 106 is moved further away from first frame 100. When extendable member 107 is fully retracted, the proximate end of second frame 106 is moved closer to first frame 100. In this manner, by extending and retracting second extendable member 107, second frame 106 can be tilted back and forth relative to the orientation of the first frame 100, therefore also tilting BOP assembly 16.

In other embodiments second extendable member 107 may be coupled in a different manner or location that still allows for the overall length of a swing arm 104 or 105 plus extendable member 107 to be increased or decreased. By changing this overall length, BOP assembly 16 may be titled. For example, second extendable member 107 may be coupled between first swing arm 104 and second frame 106 instead of between second swing arm 105 and second frame 106 or more than one second extendable member 107 may be used so that both first swing arm 104 and second swing arm 105 are coupled to a second extendable member 107 which are each coupled to second frame 106. In the illustrated embodiment of the handler, the proximate end of third extendable member 108 is pivotally coupled to the proximate end of first frame 100 at pivotal connection 125 and the distal end of third extendable member 108 is pivotally coupled to the distal end of first swing arm 104 at pivotal connection 131, as depicted in FIG. 3. Third extendable member 108 may be connected at other locations than as depicted. For example, the proximate end of third extendable member 108 may be pivotally coupled to base 101 and the distal end of third extendable member 108 may be pivotally connected to the second frame 106.

When third extendable 108 member is partially retracted second frame 106 and first frame 100 are relatively close to each other, as depicted in FIG. 2. When extendable member 108 is fully extended, second frame 106 and first frame 100 are relatively further from each other, as depicted in FIG. 3. Therefore, by fully extending third extendable member 108, second frame 106 is moved laterally away from base 101 so that second frame 106 extends further beyond the proximate end of base 101 than it would extend if third extendable member 108 was partially retracted. Comparison of FIGS. 2 and 5 indicates this movement. In FIG. 2, third extendable member 108 is relatively retracted. In FIG. 3, third extendable member 108 is extended. As can be seen by comparison of FIG. 2 to FIG. 3, second frame 106 has been shifted away from first frame 100 and second frame 106 has been elevated, relative to the position depicted in FIG. 2. Movement of second frame 106 in such a manner also moves BOP assembly 16 in the same manner. This allows for BOP assembly 16 to be elevated and suspended so that work may be performed underneath BOP assembly 16 without further support, such as a crane. This also allows for BOP assembly to be placed over and onto a well head without further support, such as a crane.

In the illustrated embodiment of the handler, BOP support 109 is coupled to second frame 106 at least at one location. FIG. 5 illustrates an example in which BOP support 109 is coupled to second frame 106 at three points by lateral shift coupling 120. Each lateral shift coupling 120 comprising two tubular members 131 in which the first tubular member is inserted into the second tubular member so the second tubular member may slide along the length of the first tubular member causing the overall length of the tubular members to vary. Lateral shift coupling 120 is further comprised of lateral shift extendable member 121, which is connected between second frame 106 and BOP support 109 so that when lateral shift extendable member 121 is extended the overall length of the tubular members is increased and when the lateral shift extendable member 121 is retracted, the overall length of the tubular members is decreased. In such a manner, lateral shift coupling 120 allows for the ability to move BOP assembly 16 in a side to side direction relative to the face of second frame 106 by extending or retracting lateral shift member 121. Such side to side movement being useful for alignment and positioning of BOP assembly 16 above and onto a well head for attachment to the well head and alignment and connection of stripper 22 to a coiled tubing injector.

BOP assembly 16 is coupled to BOP support 109 at least at one location. These couplings may allow for movement capabilities of the BOP handler. In the illustrated embodiment of the handler, BOP assembly 16 is coupled to BOP support 109 at three locations. The distal end of BOP support 109 is coupled to BOP assembly 16 by lock 111. BOP assembly 16 is constrained by and within lock 111, so that BOP assembly 16 remains secured to BOP support 109. In the illustrated embodiment, lock 111 is comprised of locking support 132, which is coupled at its proximate end to BOP support 109. Locking support 132 is configured with a notch in which BOP assembly 16 may be inserted and holes through which locking pins 133 may be inserted thereby creating an enclosure to secure BOP assembly 16.

In the illustrated embodiment of the handler, BOP assembly 16 is further coupled to the BOP support 109 by flange 112. As depicted in FIG. 2, flange 112 is coupled to mounting support 113, which is coupled to BOP support frame 109. At least one vertical lift extendable member 114 is coupled between mounting support 113 and flange 112, which is further coupled to BOP assembly 16. When vertical lift extendable member 114 is retracted or extended BOP assembly 16 is lowered or raised, respectively, in the vertical direction independently of the handler.

In the illustrated embodiment of the handler, BOP assembly 16 is rotationally coupled to BOP support 109. The rotational coupling of the illustrated embodiment is comprised of rotational support 117, which is coupled to BOP support 109 and which has an opening through which BOP assembly 16 can be inserted; rotational swivel 119, which is coupled to rotational support 117, which is capable of being rotated about an axis coincident with the vertical axis of BOP assembly 16. Rotation of BOP assembly is caused by rotational extendable member 118, which is coupled between BOP support 109 and rotational swivel 119. When rotational extendable member 118 is retracted or extended, rotational swivel 119 and the BOP assembly 16, which is supported by rotational swivel 119, rotate about an axis coincident with the vertical axis of BOP assembly 16 independent of the handler.

Use of rotational and and/or movement couplings to secure the BOP assembly 16 to BOP support 109 allows for the capability of moving the BOP assembly up and down or rotating the BOP assembly about its axis, respectively. By use of such a couplings, BOP assembly 16 may be moved independently of the BOP support 109 and remaining components of the handler. This allows for fine tuning the position of BOP assembly 16 after the linkage mechanism of the handler 10 has erected the BOP assembly to an upright position and extended BOP assembly 16 over and out from base 101. Therefore, providing for more precise movement of BOP assembly 16 than that provided for by the linkage mechanism used to erect and extend BOP assembly 16. These movement capabilities may be used for precise placement of BOP assembly 16 for alignment with and connection to a coiled tubing injector or a well head.

The illustrated embodiment is a representative example of the use of couplings that allow for movement of BOP assembly 16 and a possible combination of those coupling types. However, other coupling combinations may be used and the location of the couplings on BOP support 109 and BOP assembly 16 may vary. Furthermore, other couplings that are capable of vertically lifting, rotating, and locking BOP assembly 16 other than those described herein and illustrated could be used.

All extended members described herein may be hydraulic cylinders, as depicted in the embodiment shown in FIGS. 2 and 5. However other possible extendable members exist in the art that may be used instead of hydraulic cylinders. Instead of or in addition to a hydraulic cylinder, each extendable member mentioned herein may be comprised of a linear actuator, including a telescoping linear actuator with one or more telescoping segments, capable of carrying the loads and processing the necessary stroke or length of movement. Possible alternatives include other types of hydraulic linear actuators, as well as pneumatic actuators and mechanical actuators (such as various types of screws, rack and pinions, chains, belts, and the like), including those driven by hydraulic, electric or other types of motors.

BOP assembly 16 typically comprises a blowout preventer and typically also includes one more of the following: a stripper, one or more sections of risers for accommodating one or more down hole tools for connection to coiled tubing prior to insertion into the well bore, a flow cross, and a backup BOP. However, there could be significant variation in the components of the BOP assembly depending on the particular well, the work that needs to be performed on the well, and the down hole tools that will be used. In the illustrated embodiment depicted in FIGS. 1-5, BOP assembly 16 comprises BOP 16 and three sections of riser 20. But, the components of BOP assembly 16 may vary depending on the work to be performed at a well site and the tools to be used to perform that work. BOP assembly 16 could be comprised of more or fewer components than shown in the examples of embodiments provided in FIGS. 1-5. BOP assembly 16 could be comprised of just BOP 18. Regardless of the components of BOP assembly 16, the handler retains the capabilities to transport, erect, and move BOP assembly 16 as described herein.

The foregoing description is of exemplary embodiments. Alterations and modifications to the disclosed embodiments may be made without departing from the invention taught by the examples.

What is claimed is:

1. A BOP handler comprising:

a base;

a first frame pivotally coupled to the base and having at least two pivotal connections located at points away from each other along the first frame;

a second frame;

at least two arms, each pivotally coupled at opposite ends to the first frame and the second frame, wherein one of the at least two arms is connected to the first frame at one of the at least two pivotal connections and the other of the at least two arms is connected to the first frame at the other of the at least two pivotal connections;

wherein, at least one of the at least two arms is comprised of at least one extendable member for adjusting the length of the at least one of the at least two arms;

a first extendable member, coupled between the base and the first frame for pivoting the first frame with respect to the base;

a second extendable member, coupled between one of the first frame and base, and one of the second frame and one of the at least two arms;

a BOP support, coupled to the second frame; and at least one BOP assembly coupling for coupling a BOP assembly with the BOP support.

2. The invention of claim 1 in which the first extendable member is a hydraulic cylinder.

3. The invention of claim 1 in which the second extendable member is hydraulic cylinder.

4. The invention of claim 1 in which the at least one BOP assembly coupling rotationally couples the BOP assembly to the BOP support.

5. The invention of claim 1 in which the at least one BOP assembly coupling is capable of vertically shifting the BOP assembly.

6. The invention of claim 1 in which the at least one BOP assembly coupling is capable of laterally shifting the BOP assembly.

7. The invention of claim 1 in which the coupling between the BOP support and second frame is capable of laterally shifting the BOP support.

8. The invention of claim 1 in which the coupling between the BOP support and second frame is capable of vertically shifting the BOP support.

9. A BOP handler comprising:

a base;

a first frame having a proximal end and a distal end, pivotally coupled to the base at the proximal end;

a second frame;

at least one arm, coupled between the distal end of the first frame and the second frame;

a first extendable member, coupled between the base and the first frame for pivoting the first frame with respect to the base;

a second extendable member coupled between one of the proximal end of the first frame and the base, and one of the at least one arm and the second frame, wherein the second frame is moved laterally away relative to the base by extension of the second extendable member;

a BOP support, coupled to the second frame; and at least one BOP assembly coupling for coupling a BOP assembly with the BOP support.

10. The invention of claim 9 in which at least one of the first and second extendable members comprises a hydraulic cylinder.

11. The invention of claim 9 in which the at least one BOP assembly coupling rotationally couples the BOP assembly to the BOP support.

12. The invention of claim 9 in which the at least one BOP assembly coupling is capable of vertically shifting the BOP assembly.

13. The invention of claim 9 in which the at least one BOP assembly coupling is capable of laterally shifting the BOP assembly.

14. The invention of claim 9 in which the coupling between the BOP support and second frame is capable of laterally shifting the BOP support.

15. The invention of claim 9 in which the coupling between the BOP support and second frame is capable of vertically shifting the BOP support.

16. A BOP handler comprising:

a base;

a first frame having a proximal end and a distal end, pivotally coupled to the base at the proximal end;

a second frame;

at least one arm, coupled between the distal end of the first frame and the second frame;

a first extendable member, coupled between the base and the first frame for pivoting the first frame with respect to the base;

a second extendable member coupled between one of the proximal end of the first frame and the base, and one of the at least one arm and the second frame, wherein the second frame is elevated relative to the first frame by extension of the second extendable member;

a BOP support, coupled to the frame; and at least one BOP assembly coupling for coupling a BOP assembly with the BOP support.

17. The invention of claim 16 in which at least one of the first and second extendable members comprises a hydraulic cylinder.

18. The invention of claim 16 in which the at least one BOP assembly coupling rotationally couples the BOP assembly to the BOP support.

19. The invention of claim 16 in which the at least one BOP assembly coupling is capable of vertically shifting the BOP assembly.

20. The invention of claim 16 in which the at least one BOP assembly coupling is capable of laterally shifting the BOP assembly.

21. The invention of claim 16 in which the coupling between the BOP support and second frame is capable of laterally shifting the BOP support.

22. The invention of claim 16 in which the coupling between the BOP support and second frame is capable of vertically shifting the BOP support.

* * * * *